US006719593B2

(12) United States Patent
Garcia et al.

(10) Patent No.: US 6,719,593 B2
(45) Date of Patent: Apr. 13, 2004

(54) SCREW TERMINAL

(75) Inventors: José Garcia, Agey (FR); Serge Paggi, Ruffey les Echirey (FR); Hervé Grillot, Saint Nicolas les Citeaux (FR); Denis Bassenonville, Chevigny (FR)

(73) Assignee: Schneider Electric Industries SAS (FR)

( * ) Notice: Subject to any disclaimer, the term of this patent is extended or adjusted under 35 U.S.C. 154(b) by 0 days.

(21) Appl. No.: 10/162,567

(22) Filed: Jun. 6, 2002

(65) Prior Publication Data

US 2002/0187685 A1 Dec. 12, 2002

(30) Foreign Application Priority Data

Jun. 6, 2001 (FR) ..... 01 07624

(51) Int. Cl.[7] ..... H01R 4/36

(52) U.S. Cl. ..... 439/811; 174/84 C; 361/355; 403/362

(58) Field of Search ..... 439/810–812; 174/84 C, 40 CC; 403/362; 361/355

(56) References Cited

U.S. PATENT DOCUMENTS

| | | | | | |
|---|---|---|---|---|---|
| 2,602,104 | A | * | 7/1952 | Hubbell et al. | 439/812 |
| 2,809,363 | A | * | 10/1957 | Schertel et al. | 439/812 |
| 3,659,253 | A | * | 4/1972 | Wiessner | 439/733.1 |
| 3,836,941 | A | * | 9/1974 | Izraeli | 439/811 |
| 3,864,005 | A | * | 2/1975 | Klein | 439/812 |
| 4,103,986 | A | * | 8/1978 | Izraeli | 439/811 |
| 4,213,669 | A | * | 7/1980 | Wittes et al. | 439/811 |
| 4,629,281 | A | * | 12/1986 | Kruger | 439/791 |
| 5,747,741 | A | * | 5/1998 | Alsch | 174/84 C |
| 5,934,818 | A | * | 8/1999 | Schmitt et al. | 403/399 |
| 6,004,167 | A | * | 12/1999 | Hirakawa | 439/811 |
| 6,040,525 | A | * | 3/2000 | Chauquet et al. | 174/40 CC |

FOREIGN PATENT DOCUMENTS

| | | |
|---|---|---|
| CH | 325 260 | 10/1957 |
| DE | 712 382 | 10/1941 |
| DE | 733 024 | 3/1943 |
| DE | 21 47 046 | 4/1973 |
| NL | 63 870 | 8/1949 |

* cited by examiner

*Primary Examiner*—Tho D. Ta
*Assistant Examiner*—Larisa Tsukerman
(74) *Attorney, Agent, or Firm*—Parkhurst & Wendel, L.L.P.

(57) ABSTRACT

Screw terminal connected to a conductor device mounted on a piece of electrical equipment to connect at least one conductor, composed of a connection cage and a screw, the cage and/or the screw being movable inside the terminal housing.

A pressure device (30) composed of a head plate (31) and a pressure plate (32) connected to each other by two elastic symmetrical wings (33, 34) designed to store torque energy, the head plate being convex in shape and attached by the screw neck. The pressure plate can be applied against a conductor or against the conductor device on the equipment, and the elastic wings are concave in shape, with a concavity that is reduced as the pressure on the screw is increased.

8 Claims, 2 Drawing Sheets

SCREW TERMINAL

This invention concerns a screw terminal connected to a conductor device on electrical equipment for connecting at least one electrical conductor to this device.

In particular, it concerns a screw terminal composed of a connection cage equipped with a tapped hole, a screw with a threaded head and stem that screw into the tapped hole, and an elastic pressure device for application against the electrical conductor. The cage and/or the screw are moveable inside the housing on the electrical equipment, and the pressure device is composed of a head plate and a pressure plate connected to each other by an elastic wing that is designed to store torque energy, the head plate being subject to pressure from the screw head, and the pressure plate being applicable against the conductor or the equipment's conductor part.

The document DE U 1 935 560 describes a terminal of this type. A U-shaped stirrup pressure device, composed of a high wing and a low wing connected by a core is engaged by the high wing under the screw head and is applicable through the low wing against a conductor introduced into the cage; the stirrup core is a little higher than the length of the threaded portion in order to create pressurization. Because of the pressure exercised under the screw head, this pressurization prevents terminal loosening and/or after application of the screw stem against the low wing, to recover the creep of the conductor screw tightened by the terminal.

However, the U-shape of the pressure device leads to an unbalance during terminal use.

Document DE 40 13 225 also illustrates a screw terminal equipped with a pressure device in the form of a closed cage, where the deformation method is not described.

This invention is aimed at improving the balance of a screw terminal such as those described, while at the same time ensuring improved deformation for the pressure device, partly for the space occupied by the terminal, and partly to respect the elastic limit of the pressure device.

According to this invention the pressure device is composed of two elastic wings symmetrical with the axial plane of the screw, the elastic wings are concave shaped and the head of the screw acts on the head plate to place the pressure device under compression symmetrically when the screw is tightened. The pressure device provides an advantage by forming an interlocked ring with the rigid cage.

The conception of the pressure device is preferably designed so that the concave elastic wings change shape reducing the concavity when the strain created by the screw is increased. The head plate has a sloping or convex shape and the screw head presses on the head plate at a slight distance from the screw axis to facilitate the described reduction effect in the concavity of the sides. The pressure device can be engaged on the neck of the screw through an assembly plate composed of two circular half-sectors, and this can form or act with the elements that maintain the terminal in open position and improved insulation on the side of the opening where the conductor is inserted.

The description that follows is the non-limiting method for the production of this invention, with reference to the enclosed technical drawings.

Figure 1:
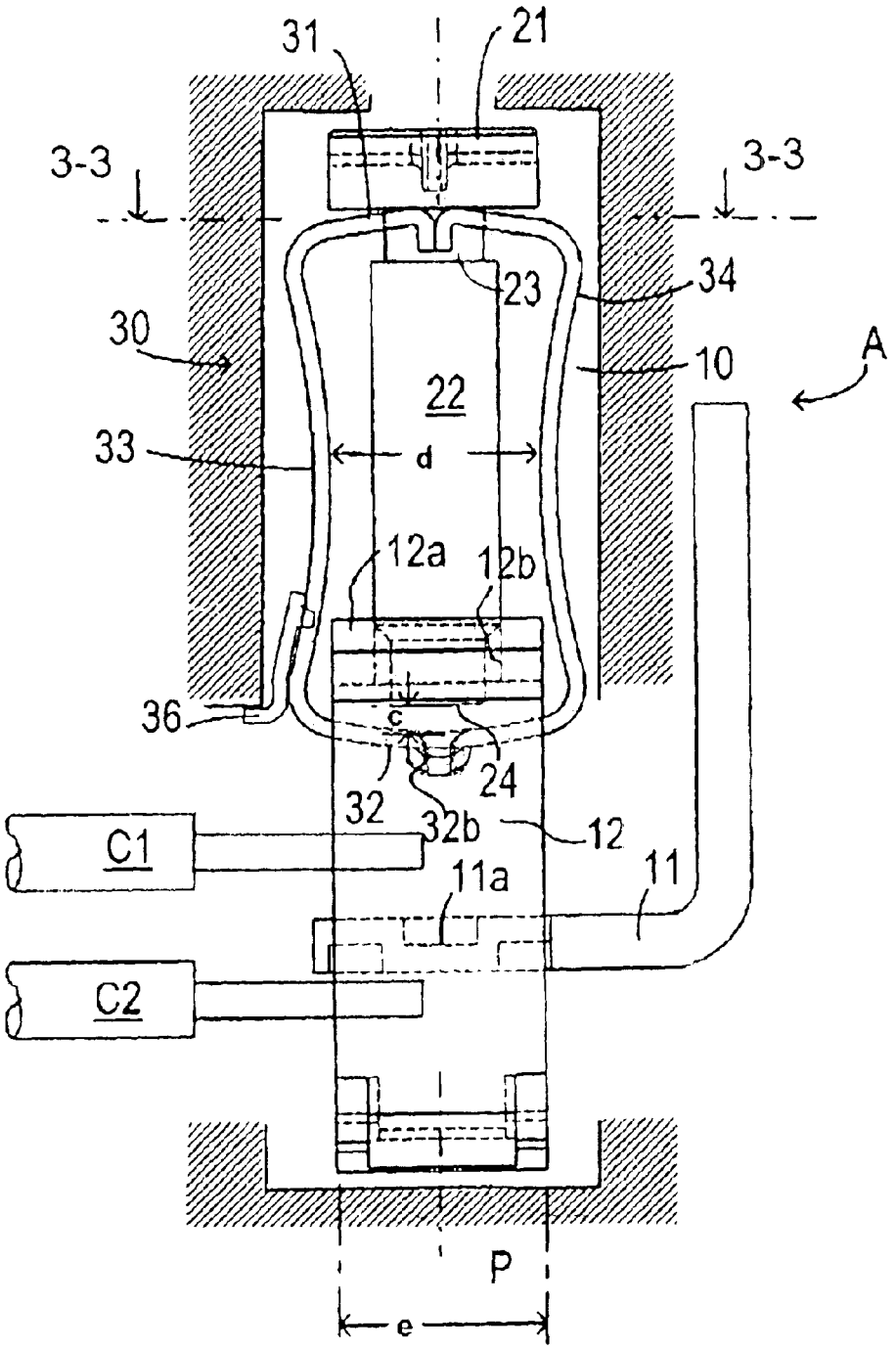
FIG. 1 is a partial cross section of the screw terminal according to this invention.
Figure 2:
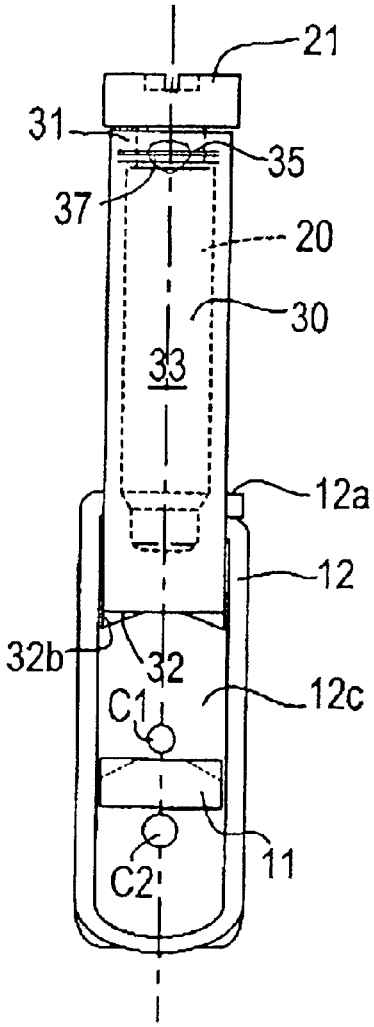
FIG. 2 is the side view of the terminal as described in FIG. 1.
Figure 3:
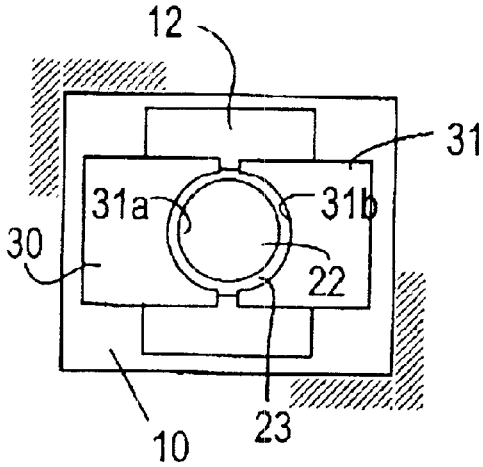
FIG. 3 is the bird's eye view of the terminal as described in FIG. 1 with a partial cross section according to sectional view 3—3.

The screw terminal A shown in the drawing is destined for being mounted on a piece of electrical equipment. The only elements of this equipment shown in FIG. 1 are the insulating housing 10 envisaged for the terminal, and a fixed connection branch from the rigid conductor 11 conductor device against which one or several conductors can be screwed in contact. In this manner, FIG. 1 shows the two conductors C1 and C2 designed to be inserted respectively above and below the branch. Housing 10 is located in the piece of electrical equipment, which means that it is envisaged inside some part of the equipment casing or in a terminal strip attached to the equipment casing.

Terminal A is composed of a cage 12 of familiar type, composed of a strip of metal cut and folded to form a rigid ring of rectangular shape. On the short side 12*a*, the rigid cage 12 has a tapped hole 12*b* and the connecting branch of the conductor device 11 is inserted crosswise in the elongated opening 12*c*, rectangular in shape, of cage 12.

Screw 20 is composed of a maneuver head 21, a threaded stem 22 and a neck 23 that connects the threaded stem to the head. The threaded stem, or the non-threaded extension of this stem is terminated at the end with a boss 24.

A pressure device 30 is coupled with the screw 20 so that both move together. Device 30 is a single elastic part closed in on itself to form a ring, and symmetrical with the axial plane P of the screw. It is composed of a head plate 31 located under the head 21 and it encircles the neck 23 of the screw, a pressure plate 32 applicable on the conductor C1 or the contact branch of the conductor device 11, and on each side of the screw axis, a concave wing 33, 34 that is connected with the plates 31, 32 through a connection zone that forms a protruding angle 35. The concavity of the wings (refer to FIGS. 1 and 4 to view the concavity) is designed so that the wings approach the screw axis at their centres. The head plate 31 is composed of two circular half sectors 31*a*, 31*b* that are engaged in the neck 23 of the screw to maintain the pressure device 30 in a balanced position. The half-sectors that form the head plate 31 are positioned so that they rise towards the head of the screw, providing the head plate with a generally sloping or convex form, and plate 31 terminates over these half-sectors with folded over axial joins 31*c* that meet at the axial plane P of the screw.

The pressure plate 32 is curved to provide a generally convex form for the lower portion of device 30 and presents ridges 32*b* that correspond with the recess 11*a* of the conductor device 11.

Figure 4:
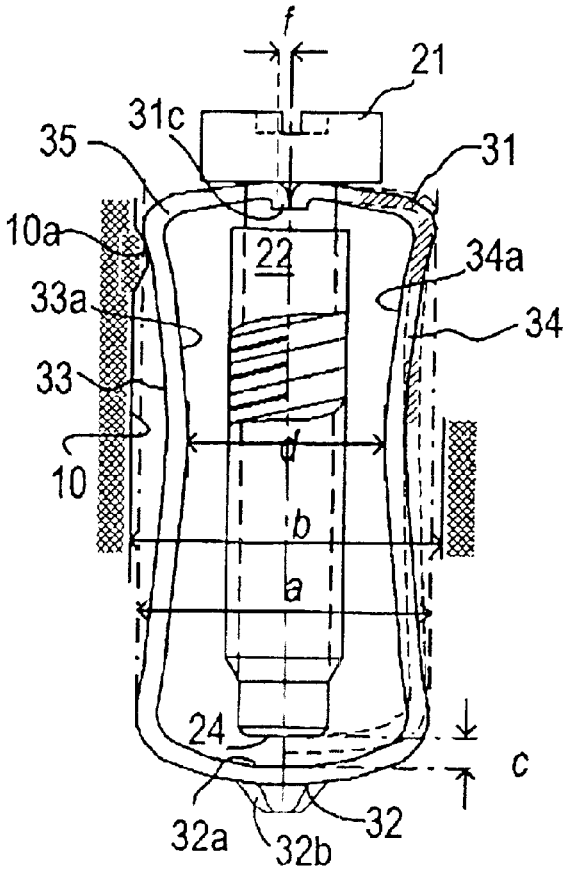
FIG. 4 illustrates the screw terminal action.

As illustrated in FIGS. 1 and 4, device 30 is designed so that the concavity of its wings 33, 34 combines with the convex shape of the plates 31, 32 permitting deformation through compression, with a curve that is reduced as the pressure is increased. It can be noted that the reduction of the concavity is simultaneous with the maintaining of the device 30 in the contour defined by the protruding angles 35, this contour being less than the width b of housing 10 for guidance needs.

In rest position, a slight distance C is foreseen between the boss 24 of the screw and the internal face 32*a* of the pressure plate 32. This distance has been calculated so that the compensation provides the required stress level of the pressure device. The minimal distance d (observed in rest position) between the internal faces 33*a*, 34*a* of the wings 33, 34 is slightly larger than the width e of the cage 12 so that the cage can slide freely between the wings or vice-versa. The head 21 of the screw is applied against the head plate 31 of the pressure device in an area located at a very slight distance f from the screw axis so that, through the plate 31 it creates a lever arm that accentuates the torque exercised on device 30.

The internal walls of the insulating housing 10 have at least one blocking rim 10*a* that act with the heading formed by the upper angle of the pressure device to block the terminal in open position. At the same time, the insulating flap 36 that reduces the danger of over-rapid contact is fixed to wing 34 so that it moves with the pressure device and masks part of the conductor insertion opening. Stamped zones 36 can be provided in the strongly stressed region of angles 35.

Below is a description of the terminal action. It can be noted that according to the piece of equipment on which this terminal is mounted, the terminal clamps an upper conductor C1, or a lower conductor C2, or both conductors C1 and C2. The translation motion of the screw and the cage can be varied according to employment.

For example, when conductor C1 is clamped, through the threaded action in the tapped hole 12*b*, the screw rotation makes cage 12 rise until it is in contact with the lower face of the fixed conductor branch 11, at the same time as the descent of the screw in relation to cage 12 and to housing 10. The descent continues until contact is made with the lower area of the pressure plate 32 against the face opposite branch 11. Continuation of the screw rotation will provoke stress on the pressure device 30 through compression. This reduces the concavity of the wings 33, 34 and the application of the boss 24 of the screw against the internal face 32*a* of the pressure plate 32. (This action is illustrated by the dotted lines in FIG. 4). It is worth noting that the head of the screw creates compression on the head plate, to facilitate the respecting of the elastic limit of device 30. The torque energy stored in the wings 33, 34 of device 30 contributes towards preventing the loosening of the screw by over-rapid rotation (action exercised by the head plate 31 on the head 21) and towards recovering the creep play of conductor C1 by moving the pressure plate 32 in relation to the boss 24 of the screw, with an amplitude that can attain c.

What is claimed is:

1. A screw terminal comprising:

a connection cage having a tapped hole;

a screw having a head, a neck, and a threaded part for threaded engagement with the tapped hole, wherein the cage threadingly travels along the screw while the screw rotates, and the cage and/or the screw is movable inside an equipment housing; and a pressure device comprising a head plate and a pressure plate connected to each other by two elastic wings for storage of torque energy, the head plate for compression by the head of the screw and the pressure plate for application of pressure against a conductor, wherein:

the two elastic wings are symmetrical in relation to an axial plane of the screw, and are concave such that centers of said wings are closer to the axial plane of the screw than ends of said wings, and the head plate is compressed by the head of the screw to place the pressure device symmetrically in compression when the screw is tightened.

2. The screw terminal according to claim 1, wherein the pressure device has a predetermined shape and position for deforming the concave elastic wings to reduce curvature of said wings when strain by the screw on the head plate is increased.

3. The screw terminal according to claim 1, wherein the head plate of the pressure device comprises a convex shape or shape sloping towards the head of the screw and the head of the screw is for compressing the head plate at a predetermined distance from the screw axis.

4. The screw terminal according to claim 1, wherein the pressure plate of the pressure device comprises a convex shape located facing the conductor device.

5. The screw terminal according to claim 1, wherein the head plate of the pressure device comprises two circular half-sectors engaged in the neck of the screw and terminating with a fold over to form a join.

6. The screw terminal according to claim 1, wherein the pressure device comprises a ring interlaced with the connection cage, and internal faces of the concave wings have a predetermined distance therebetween slightly wider than the cage.

7. The screw terminal according to claim 1, further comprises a blocking ridge wherein a connection zone of a concave elastic wing with the head plate defines a protruding angle that acts with a blocking ridge created inside the terminal housing to maintain the terminal in open position.

8. The screw terminal according to claim 1, in which an insulating flap is fixed to one concave wing (34) of the pressure device.

* * * * *